US005904010A

United States Patent [19]

Javid et al.

[11] Patent Number: 5,904,010

[45] Date of Patent: May 18, 1999

[54] ELASTOMERIC SEISMIC ISOLATION BEARING AND METHOD

[75] Inventors: Ahmad E. Javid, San Jose; James M. Kelly; Jerome L. Sackman, both of Berkeley, all of Calif.

[73] Assignee: Energy Research, Inc., San Jose, Calif.

[21] Appl. No.: 08/872,775

[22] Filed: Jun. 10, 1997

[51] Int. Cl.[6] ..... E04H 9/02

[52] U.S. Cl. ..... 52/167.7; 52/167.1; 248/634; 384/36

[58] Field of Search ..... 52/167.1, 167.3, 52/167.4, 167.5, 167.6, 167.7, 167.8, 167.9, 223.1, 223.6, 223.7, 223.14; 428/113, 114; 248/634, 638; 384/36, 37

[56] References Cited

U.S. PATENT DOCUMENTS

| | | | |
|---|---|---|---|
| 3,852,931 | 12/1974 | Morse et al. | 52/167.1 X |
| 4,179,104 | 12/1979 | Skinner et al. . | |
| 4,593,502 | 6/1986 | Buckle | 52/167.7 |
| 4,633,628 | 1/1987 | Mostaghel . | |
| 4,695,169 | 9/1987 | Baigent | 384/36 |
| 4,713,917 | 12/1987 | Buckle et al. | 52/167.1 |
| 4,731,966 | 3/1988 | Fujita et al. | 52/167.1 |
| 4,830,927 | 5/1989 | Fukahori et al. | 52/167.7 X |
| 4,887,788 | 12/1989 | Fischer et al. | 52/167.1 X |
| 4,899,323 | 2/1990 | Fukahori et al. | 52/167.7 X |
| 4,910,930 | 3/1990 | Way | 52/167.1 |
| 4,938,633 | 7/1990 | Wu et al. . | |
| 4,950,528 | 8/1990 | Iizuka et al. | 52/167.1 X |
| 4,953,658 | 9/1990 | Goto | 52/167.1 X |
| 4,991,366 | 2/1991 | Teramura et al. . | |
| 5,014,474 | 5/1991 | Fyfe et al. | 52/167.8 |
| 5,062,618 | 11/1991 | Yamada et al. . | |
| 5,152,110 | 10/1992 | Garza-Tamez . | |
| 5,161,338 | 11/1992 | Tada . | |
| 5,195,716 | 3/1993 | Tyler . | |
| 5,233,800 | 8/1993 | Sasaki et al. | 52/167.1 |
| 5,370,352 | 12/1994 | Platus . | |
| 5,438,806 | 8/1995 | Reinhall | 52/167.1 |
| 5,461,835 | 10/1995 | Tarics . | |
| 5,491,937 | 2/1996 | Watson et al. . | |
| 5,669,189 | 9/1997 | Logiadis et al. | 52/167.8 X |

FOREIGN PATENT DOCUMENTS

| | | | |
|---|---|---|---|
| 2683615 | 5/1995 | France | 52/167.1 |
| 6-158908 | 6/1994 | Japan | 52/167.1 |

OTHER PUBLICATIONS

J.M. Kelly; "Earthquake–Resistant Design with Rubber"; Second Edition, *Springer–Verlag London Limited;* (1997); Chapter Five, 13 pages.

Ronald L. Mayes et al.; "The Economics of Seismic Isolation in Buildings"; *Earthquake Spectra;* vol. 6, No. 2; (1990); pp. 245–252.

*Primary Examiner*—Carl D. Friedman
*Assistant Examiner*—Laura A. Callo
*Attorney, Agent, or Firm*—Skjerven, Morrill, MacPherson, Franklin & Friel LLP

[57] ABSTRACT

A fiber reinforced elastomeric seismic isolation bearing and method protects structures and their contents from the damaging effects of earthquakes. The bearing is a block of a specially designed composite material consisting of an elastomer matrix in which are embedded, through its depth, high stiffness pretensioned fibers extending in various horizontal directions. This produces a device which has a very low horizontal stiffness compared to its vertical stiffness. The isolator is mounted between, and connected to, the structure it supports and the foundation upon which it bears. Because of its low horizontal stiffness the bearing decouples the structure which it supports from the damaging horizontal components of the ground motion associated with an earthquake while the benign vertical motion is transmitted into the structure almost unchanged. Thus, during an earthquake, the structure, which typically will rest on several supporting isolators, and its contents experience small acceleration, velocity and deformation. The isolation bearing and method includes the use of elastomeric laminae with parallel pretensioned fibers, forming a series of cells which are vulcanized into an adherent connection and positioned to be connected between a structure and a structure foundation.

22 Claims, 8 Drawing Sheets

ELASTOMERIC SEISMIC ISOLATION BEARING AND METHOD

FIELD OF THE INVENTION

This invention relates to improvements in seismic isolation bearings, particularly to seismic isolation bearings and a method for reducing the multiple effects of earthquake vibration waves on the structure and contents of buildings.

BACKGROUND OF THE INVENTION

Seismic isolation as a way of protecting structures from the damaging motions of earthquakes is an idea that has been known for about a century. However it is only relatively recently that this concept has been put into practice. The recent history and design criteria for rubber-based isolators or bearings is seen in the book Earthquake-Resistant Design with Rubber by J. M. Kelly, Second Edition, Springer-Verlag London Limited, 1997, particularly in Chapter Five. The two basic types of isolation systems that have been employed are elastomeric bearings and sliders. The most widely adopted unit is the elastomeric bearing. Its most recent form is as a multilayered laminated bearing with alternating layers of rubber and steel. The stiff steel plates provide lateral constraint of each rubber layer when the bearing is subjected to vertical load, but does not constrain the horizontal shearing deformation of the rubber layers. This produces a bearing which is very stiff in the vertical direction and very flexible in the horizontal direction. Rubber energy-absorbing bearings with and without surrounding shell members are seen in U.S. Pat. Nos. 4,887,788 including a core of incompressible dampening material; 5,014,474 including alternating layers of elastomeric load bearing pads, one type accommodating sliding motion between a structure and its foundation; 4,910,930 including spaced steel shim plates with rubber layers sandwiched therebetween and vulcanized in situ with the shim plates; and 4,899,323 including laminated rigid hard plates and soft plates of a viscoelastic material having certain physical properties. The latter patent includes rubbers or thermoplastic resin with or without a powder or fiber filler.

By mounting a structure on a system of such horizontally soft support, the fundamental frequency of the isolated system can be made to be much lower than the fixed-base natural frequency of the structure and, consequently, the predominant frequency of the earthquake ground motion. By so doing, the bearings deflect the earthquake motion from entering the structure. Thus, earthquake protection for the structure can now be provided not by the expensive, brute-force method of building an exceedingly strong structure, but by the economic and elegant alternative of using base isolation.

It is thus desirous that a seismic isolation bearing be constructed which minimizes or essentially prevents inter-story drift and floor accelerations in the multi-story building, provides stability for the design displacement due to the earthquake, increases resistance with increasing displacement and which has properties that do not degrade under repeated cyclic loading.

SUMMARY OF THE INVENTION

The use of isolation bearings as a strategy for the seismic design of structural systems is made attractive, more efficient and more economical by fundamentally altering the notion of an isolation bearing. The seismic isolation bearing most commonly used nowadays is a mechanical system composed of alternating slabs of rubber and steel. The purpose of the steel plates is to constrain the lateral deformation of the rubber slabs under vertical load in order to achieve sufficient vertical stiffness of the bearing. However, by constructing a bearing in this manner, certain drawbacks ensue. The steel adds considerable weight to the bearing, and complicates its fabrication. It would be most advantageous to devise an alternative scheme to accomplish the major functions of a seismic isolation bearing while avoiding the penalties of excess weight and complicated fabrication.

The present invention accomplishes these ends by replacing the use of a mechanical system as a base isolator with the employment of a new man-made type of material now modified in use to directly provide the desired isolation function. This material is a pretensioned fiber-reinforced elastomeric composite. In this way, modern advances in the manufacture of high stiffness, high strength fiber materials (which are now readily available) are taken advantage of by suitably incorporating them into a matrix of elastomeric material. These fibers (in the form of either threads or woven mats) will take over the function of the steel plates of conventional rubber isolation bearings and thereby replace them.

The fabrication of isolation bearings directly from such a material simplifies and makes for more efficient, speedy and economical manufacture. Thus, the timely supply of seismic isolation bearings to the construction site in whatever numbers and configurations desired will be effectively accomplished by the use of the present invention. This invention results in lightweight bearings which are easier and more economical to transport and to manipulate on the construction site.

The elastomeric seismic isolation bearing of the invention includes a stacked series of elastomeric laminae forming a unit cell having a stacked height corresponding to an overall horizontal and vertical stiffness of the unit, the laminae being in a vulcanized adherent connection with each other; and wherein at least one of the laminae includes a series of pretensioned continuous fibers extending across opposite side edges of the laminae.

DETAILED DESCRIPTION OF THE INVENTION

Figure 1:
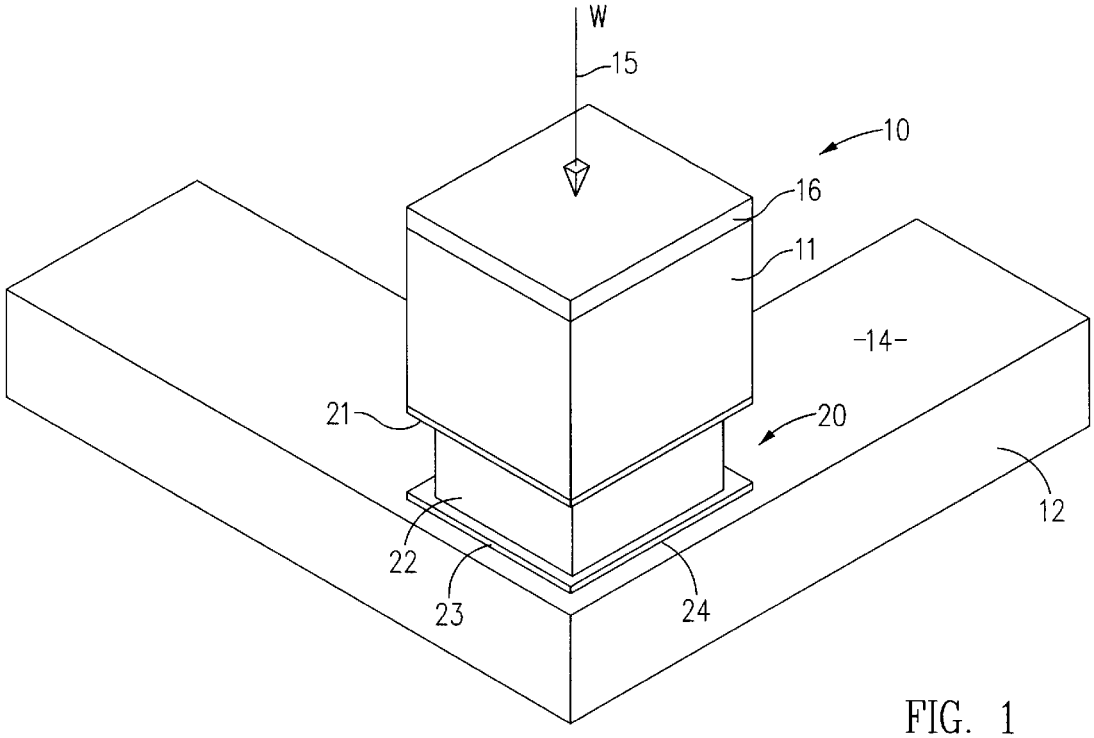
FIG. 1 is a schematic perspective view of a square isolation bearing under load between a structure support column and a structure foundation and at a structure corner.
Figure 2:
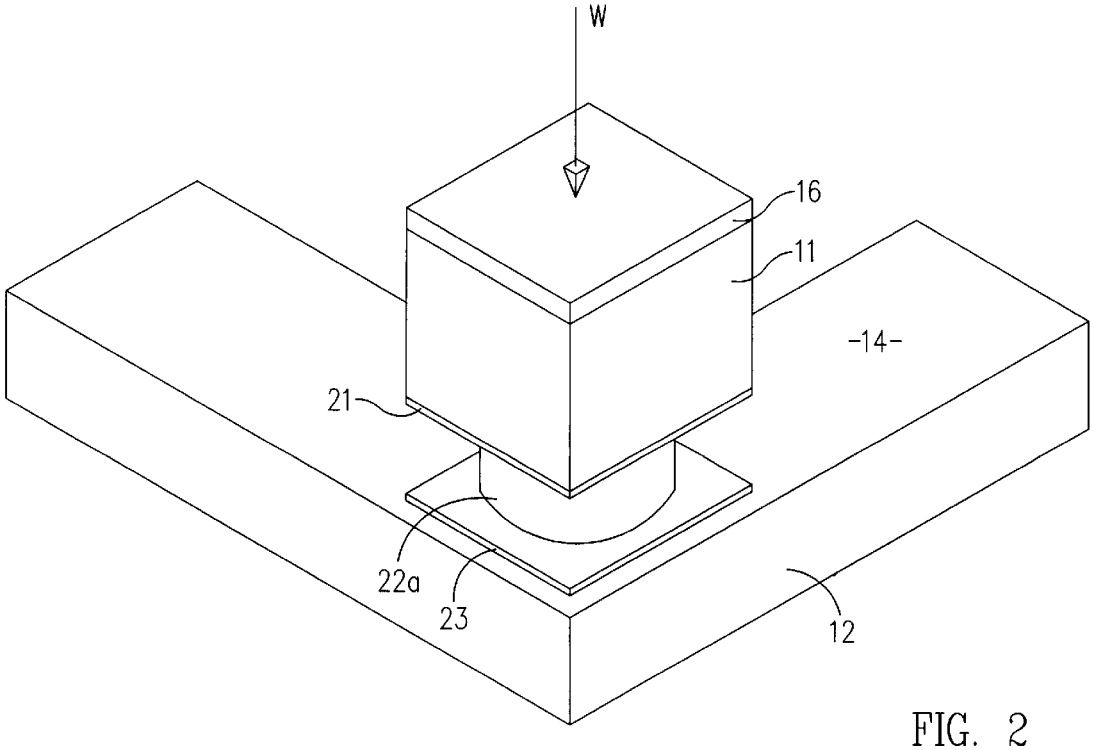
FIG. 2 is a schematic perspective view of a round embodiment thereof.

The isolation bearings of the invention are in the form of blocks of composite material with planforms of any desired shape (e.g., rectangular, circular—with or without an inner bore), but most often of square or round cross-section as shown in FIGS. 1 and 2. Particularly the isolation bearings are employed in a structural system 10 where a bottom of a structural column 11 having a sill 16 is connected to or rests on an isolation bearing 20 including a steel top end plate 21, and a series of unit cells 22 made up of a stacked series of elastomeric laminae having a series of pretensioned continuous fibers (FIGS. 3–8) extending across opposite edges of each lamina is in vulcanized adherent connection with the top end plate 21. A steel bottom end plate 23 is also in vulcanized adherent connection with the stacked elastomeric laminae and is connected by a strong epoxy bond 24 or by suitable bolting (not shown) to a top surface 14 of the structure foundation, typically a rebar-containing concrete 12. In the embodiment of FIG. 1 the laminae cells are square or rectangular while in FIG. 2 the series of cells 22*a* are circular in plan view. Arrow 15 represents a proportionate share of the weight W of the overall structure being supported by multiple structural columns on sills and multiple spaced isolation bearings 20.

Figure 3:
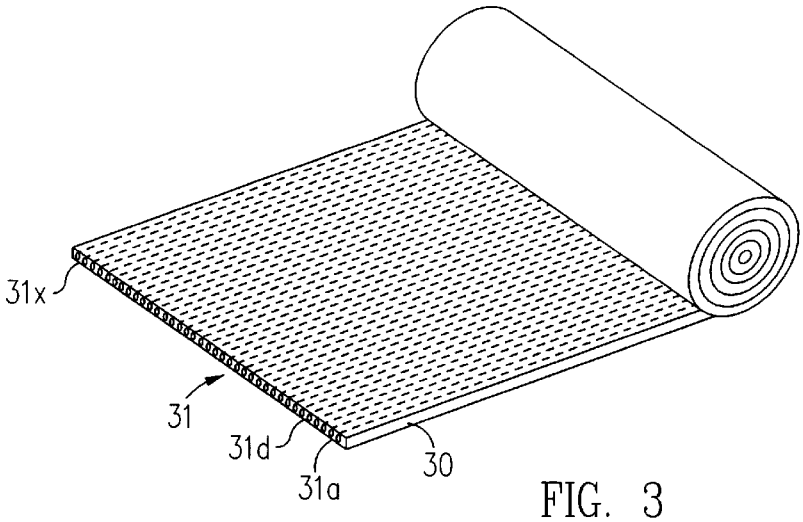
FIG. 3 is a schematic perspective view of unidirectional reinforced lamina per se of the invention.
Figure 4A:
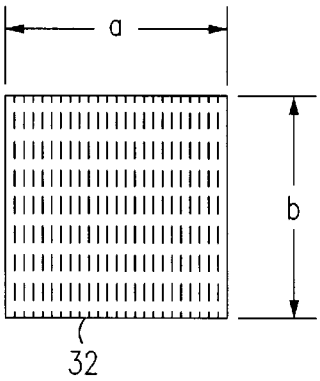
FIG. 4*a* is a plan view of a square planform of the lamina with parallel reinforcement fibers extending between two opposite side edges.
Figure 4B:
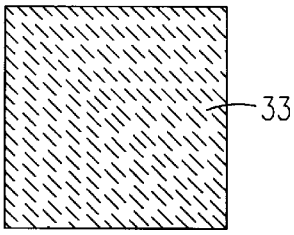
FIG. 4*b* is a plan view of a square planform with parallel reinforcement fibers extending at a 45° bias to each side edge.
Figure 4C:
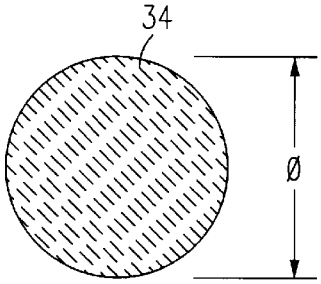
FIG. 4*c* is a plan view of a circular planform with parallel reinforcement fibers.

There are several ways in which these blocks can be manufactured, depending upon specific applications. One manufacturing procedure is as follows: first, continuous slabs of elastomer containing a uniform distribution of straight prestretched reinforcing threads are produced (similar to the manufacture of commercial rubber belting materials or commercial high strength composite tapes), as shown in FIG. 3. The belting may be stored in a roll-form 30 and include a series 31 of parallel pretensioned fibers 31*a*–31*x*. In this process the fibers are sufficiently pretensioned so as to eliminate any slack in them. From these slabs, circular (FIG. 4*c*) or square (FIG. 4*a* and FIG. 4*b*) pieces are cut out of the slabs, depending on whether circular or square planform bearings are to be fabricated. For the square cross section, such cutouts 32 are taken parallel to the fiber reinforcement (FIG. 4*a*), parallel to edge b and perpendicular to edge a, and also on the bias 33 (at 45°), as shown in FIG. 4*b*.

Figure 5:
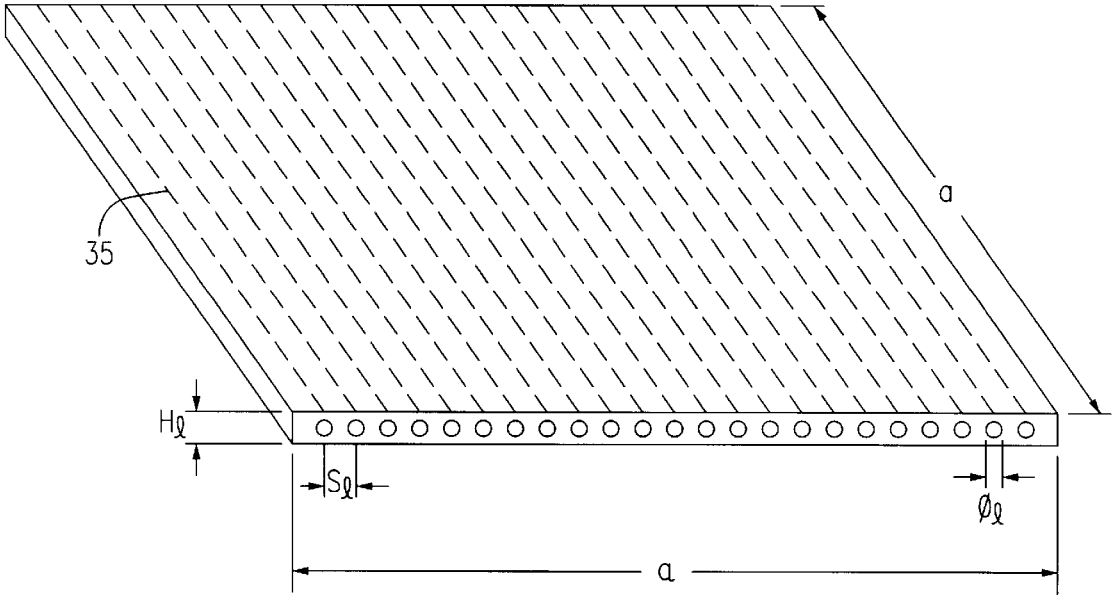
FIG. 5 is a schematic perspective view of a reinforced lamina showing the spacing of the fibers.

These pieces form the basic lamina from which the bearing will be constructed. The geometric details of a lamina (i.e., the planform dimension [the diameter "$\phi$" for solid circular planform bearings, or the edge length "a" for solid square planform bearings]; the thickness "$h_l$" of the lamina; the diameter of the reinforcing fibers "$\phi_l$"; and the spacing of the fibers "$s_l$") are shown in FIG. 5. To complete the specification of the basic lamina, it is also necessary to designate the type of elastomer and the type of reinforcing fiber material. All of these quantities can be selected by the designer of the bearing to suit the needs of the particular structure which is being considered for seismic isolation. The lamina can then be manufactured to the designer's specifications. Typically, the laminae may be constructed of natural rubber, ethylene-propylene rubber, nitrite rubber, halogenated butyl rubber, chloroprene rubber, isoprene rubber, styrene-butadiene rubber, butadiene rubber, acrylic rubber, polyurethane rubber, elastomer, or other applicable thermoplastic or thermosetting elastomers. The fibers may be Kevlar®, a resin fiber made from a lyotropic liquid crystalline polymer such as an aromatic polyamide, which has a tensile strength higher than steel and has a much lower density, boron-graphite or graphite, or glass fiber. A preferred rubber is natural rubber incorporating elongated pretensioned Kevlar® fibers. Preferably the lamina with fibers are only partially vulcanized in the lamina form. Preferably the rubber has an elongation-to-breakage of from 400–600%.

Figure 6:
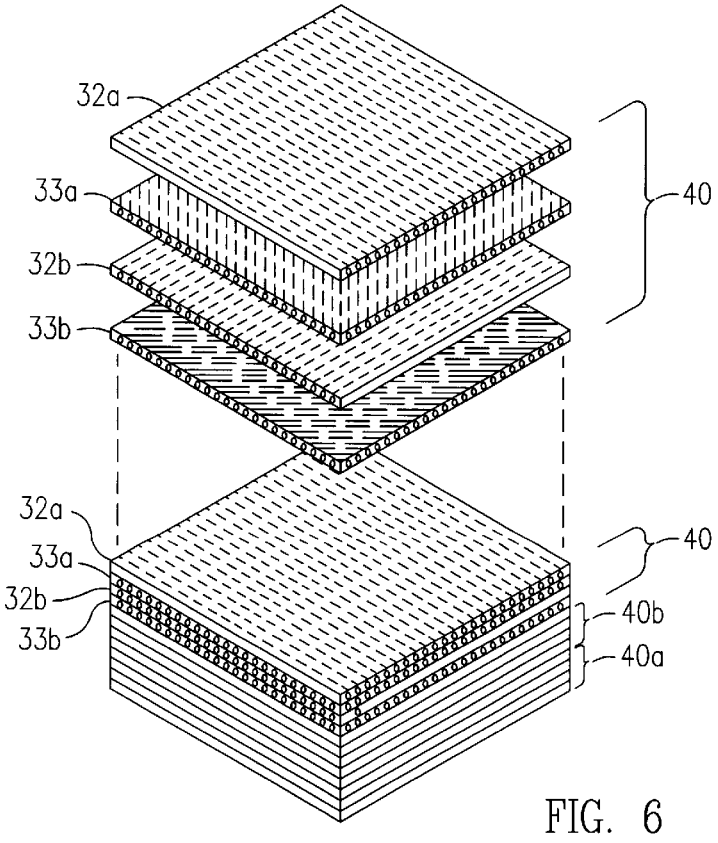
FIG. 6 illustrates a stacking sequence of a typical four, square laminae making up a unit cell, and several unit cells making up the vulcanized bearing.
Figure 7:
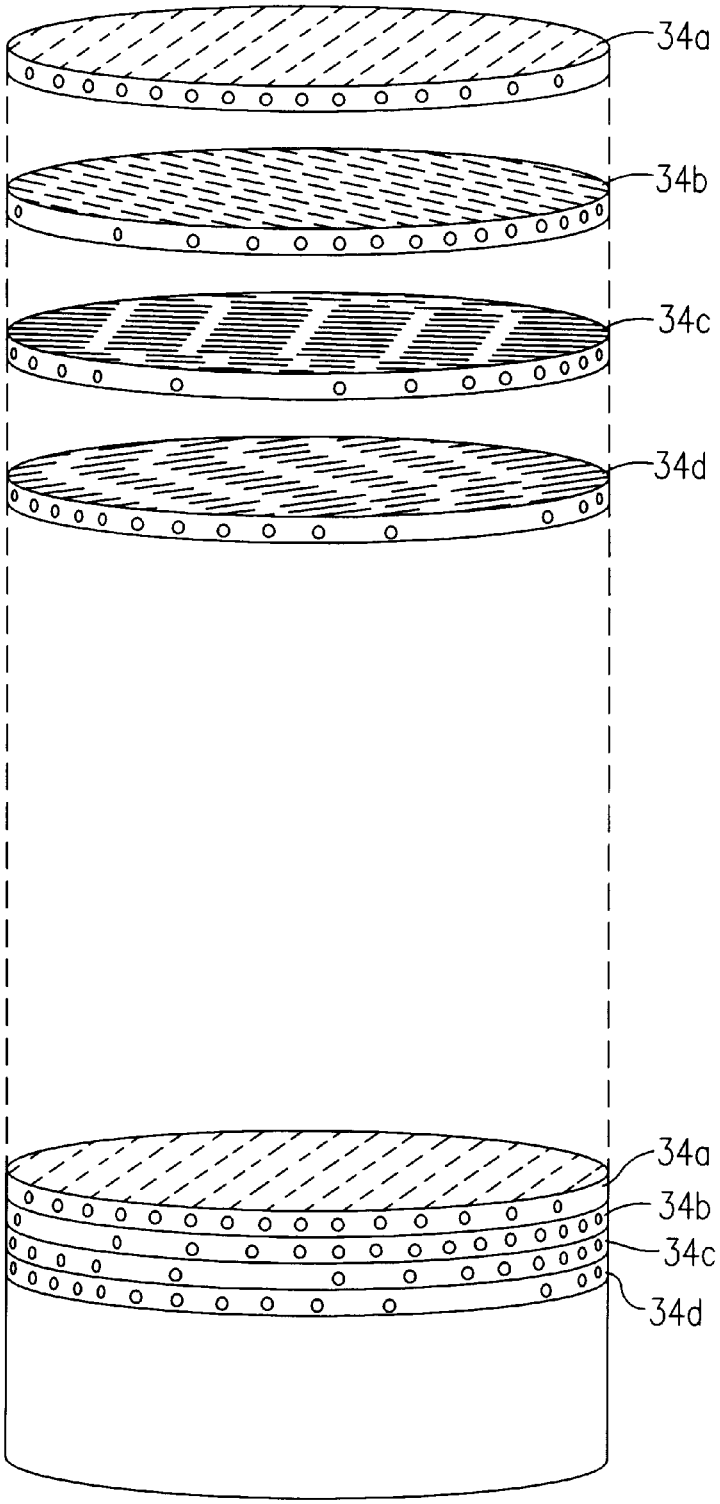
FIG. 7 illustrates a stacking sequence of a typical four, circular laminae making up a unit cell and several unit cells making up the vulcanized bearing.
Figure 8:
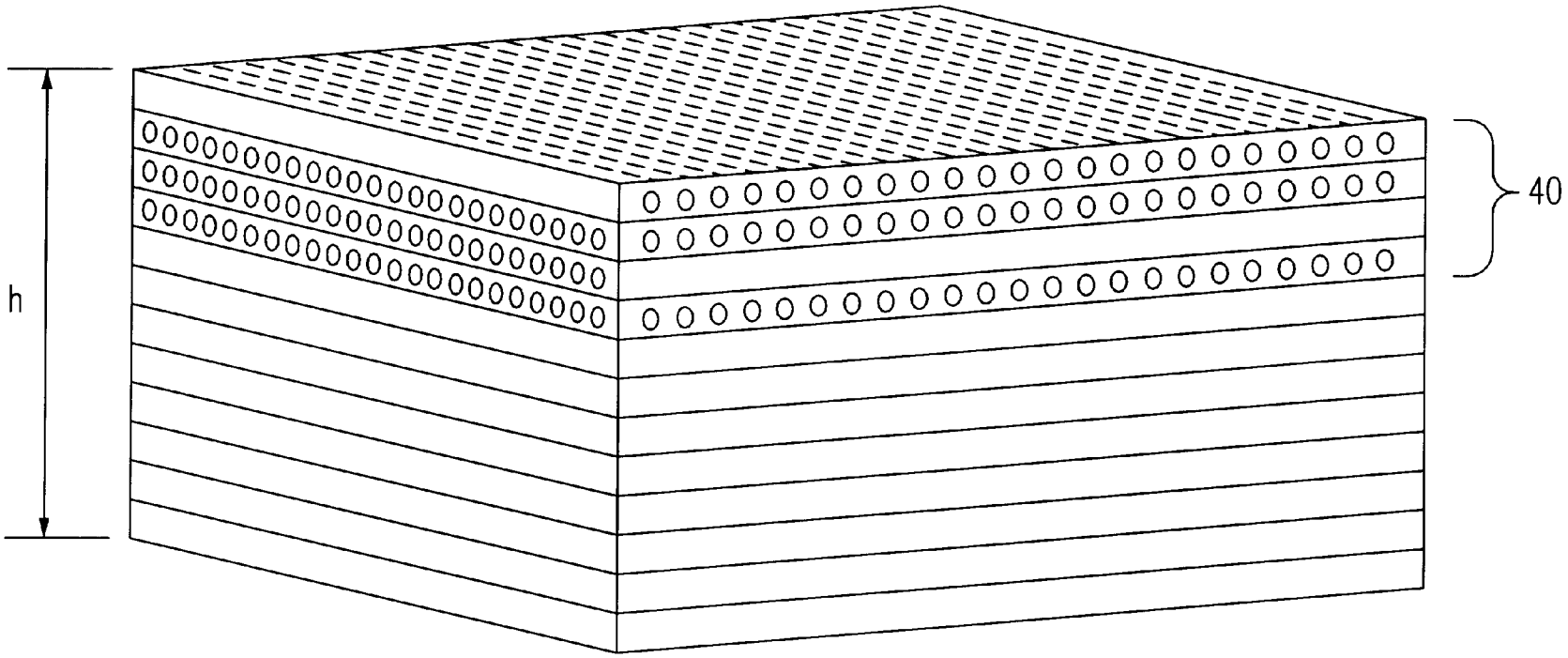
FIG. 8 shows a perspective view in greater detail of the ends of the reinforcement fibers.

Four such laminae are stacked in the sequence shown in FIG. 6 for the square bearing. A similar stacking can be used for a round bearing. This combination forms a "unit cell" 40 which has horizontal shearing stiffness which is nearly isotropic. These unit cells are repeatedly stacked on each other to produce a bearing of prescribed height "h" as shown in FIG. 8 Thus, a first stack 40*a* and a second stack 40*b* may be formed, each similar to stack or unit cell 40 which comprises a first top layer 32*a* with parallel pretensioned fibers extending from a first pair of opposite sides of the top lamina, a second layer 33*a* at a 45° angle bias, a third layer 32*b* at a 90° angle to the first top layer and a fourth layer 33*b* orthogonal to the second layer and also at a 45° bias from the side edge of the square planform. The height "h" is at the discretion of the bearing designer and is usually chosen so as to produce a bearing of some desired overall horizontal and/or vertical stiffness. Finally, the laminae are bonded to each other by fully vulcanizing the entire unit under heat and pressure into vulcanized adherent connection so as to produce an integral bearing.

Another manufacturing method is to proceed as described above for the first manufacturing process, but at the stacking stage introduce an alternative pattern. As before, four basic laminae are stacked in the sequence shown in FIG. 6 to form a unit cell. Then one or more unreinforced elastomeric laminae of a prescribed thickness are stacked on top of the unit cell. This produces a "modified unit cell" which is then repeated in the stacking sequence to produce a bearing of prescribed height "h". The choice of the thickness of each planform elastomeric lamina and their number in the modified unit cell, as well as the overall height "h" of the isolation bearing, are at the discretion of the bearing designer. The bearing can be manufactured to match whatever selection is made. As before, the laminae are bonded to each other by vulcanizing the entire unit under heat and pressure.

Another manufacturing method is to proceed as described above for the first manufacturing process, but in the fabrication of the continuous slabs of elastomer containing a uniform distribution of straight prestretched reinforcing threads, the layer of threads is replaced by a thin sheet of prestretched fabric such as Kevlar® fabric woven from high strength fibers. A single sheet of fabric provides closely spaced embedded fibers both in the direction of the edge of the continuous slab of elastomer and at right angles to it (in the plane of the continuous slab). To manufacture a bearing with a square planform, a basic lamina is cut out of the continuous slab parallel to the fiber reinforcement and another on the bias (at 45°). This is similar to what is displayed in FIG. 4*c*, except that each lamina now has woven fibers running in orthogonal directions in the plane of the lamina. Thus a single lamina, with the fibers running in the direction of the edges of the lamina plays the role of what was previously accomplished by two laminae together such as ply 1 (32*a*) and ply 3 (32*b*) shown in FIGS. 6 and 7. Similarly the single lamina that was cut out on the bias now plays the role of what was previously accomplished by two laminae together such as ply 2 (33*a*) and ply 4 (33*b*) shown in FIG. 6. A "new unit cell" now consists of two laminae with woven fabric reinforcement: one lamina with the orthogonal fibers of the woven fabric in the directions of (and perpendicular to) its edges, and one lamina with the orthogonal fibers of the woven fabric at 45° to the directions of its edges. These new unit cells are repeatedly stacked on top of each other to produce a bearing of prescribed height "h". The laminae are then bonded to one other by vulcanizing the entire unit under heat and pressure. Bearings of circular planform (FIG. 7), namely laminae 34*a*, 34*b*, 34*c*, and 34*d*, fabricated in a similar manner.

Another manufacturing method is to proceed as described above for the third manufacturing process, but at the stacking stage introducing an alternative pattern. As in the immediately proceeding procedure, two basic laminae are stacked in the sequence described in that procedure to form a new unit cell. Then one or more unreinforced elastomeric laminae of a prescribed thickness are stacked on top of the unit cell. This produces a "modified new unit cell" which is then repeated in the stacking sequence to produce a bearing of prescribed height "h". The choice of the thickness of each planar elastomeric lamina and their number in the modified new unit cell, as well as the over all height "h" of the isolation bearing, are at the discretion of the bearing designer. The bearing can be manufactured to match whatever selection is made. As before, the laminae are bonded to each other by vulcanizing the entire unit under heat and pressure.

Another manufacturing method is to first fabricate continuous slabs of unreinforced elastomer. From these slabs, circular or square pieces are cut out of the slabs, depending on whether a circular or a square planform bearing is to be fabricated. (These pieces form one set of basic laminae from which the bearing will be constructed.) Then one or more of these unreinforced elastomeric laminae of a prescribed thickness are stacked on top of each other. This produces one portion (strictly of unreinforced elastomer) of the "unit cell" of the bearing. On top of this portion of the unit cell is placed a constraining slab (of the same planform as the elastomer laminae) which is made of a commercially available high stiffness fiber reinforced-epoxy matrix composite plate that is essentially isotropic in its planform plane. This constraining slab makes up the remaining portion of the "unit cell" as seen for example in FIG. 8. Next, unit cells are repeatedly stacked on top of each other to attain a desired height "h" of the bearing. Finally, the laminae and the constraining slabs are bonded to each other by vulcanizing the entire unit under heat and pressure.

Another manufacturing method is to proceed as described immediately above, except that some (or all) of the previously unreinforced elastomeric lamina can be reinforced with pretensioned threads or with pretensioned woven fabric.

Yet another method is to weave a special fabric of high-strength threads each as Kevlar® material which will have all the possible orientations, i.e., x-axis, y-axis and 45° axes, to create a homogeneous lamina which can be used as each lamina in the stack of laminae and which may include rubber-only laminae in the stack.

Figure 9:
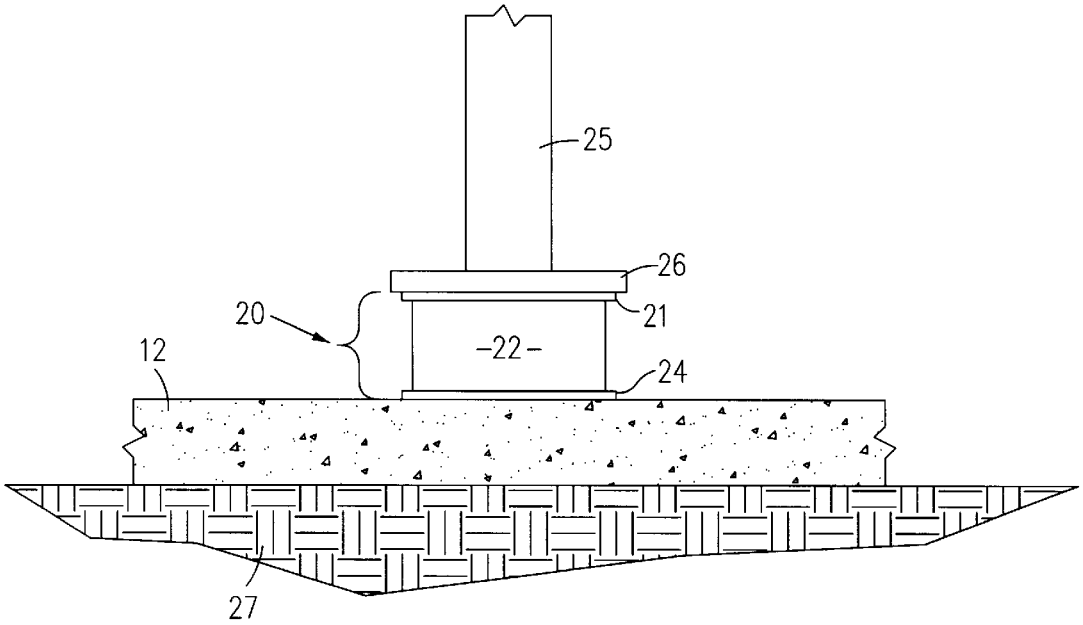
FIG. 9 is a side view of an isolation bearing installation prior to any seismic event.
Figure 10:
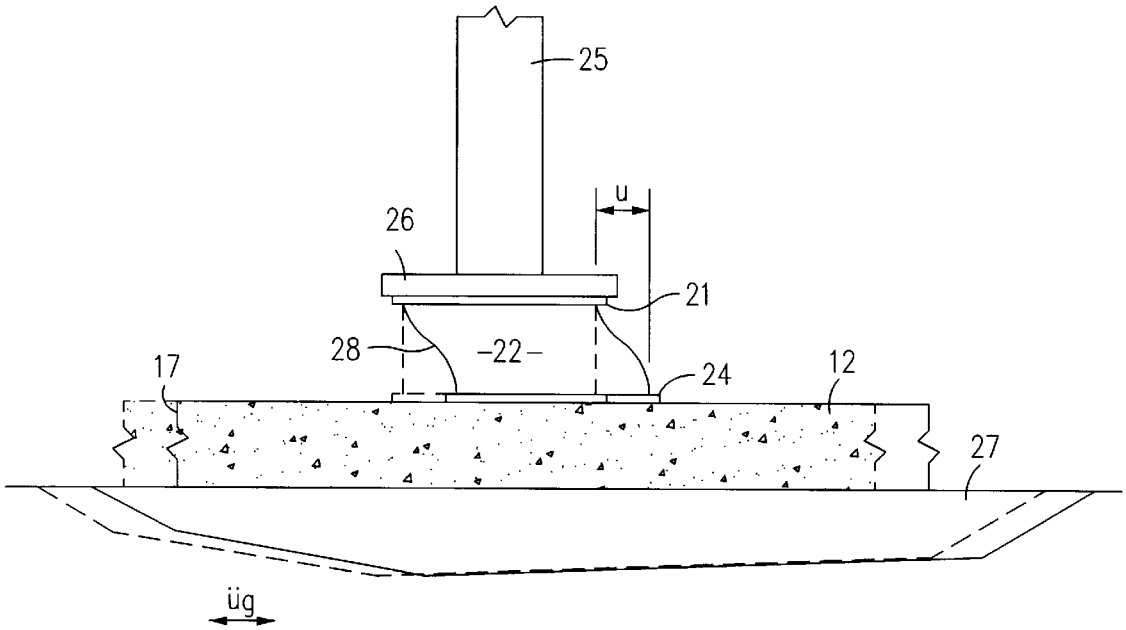
FIG. 10 is a side view of an isolation bearing showing the displacement of the isolation bearing during ground motion from a seismic event.

As more clearly seen in FIGS. 9 and 10, the next step in the manufacture of the overall isolation bearing (be it of any type described above) is to attach end plates to it. These are used to connect the isolation bearing to the structure which it supports and to the foundation upon which it bears. The seismic isolation bearing is typically attached to the structure 25 which it supports by connecting a top end plate 21 to a structural base plate 26. This is depicted in FIG. 9 for the case where a column is the structural element which is used to transmit a portion of the weight of the structure (and its contents) through the isolation bearing to the foundation 12. In a similar manner, the bottom end plate 24 is connected to the foundation 12 as shown in FIG. 9. In other situations a load bearing wall or a shear wall may be the structural element which is used to transmit a portion of the weight of the structure (and its contents) through the isolation bearing into the foundation.

Depending upon the particular application, the material of an end plate may be a metal (typically steel), a laminated high stiffness, high strength fiber reinforced-epoxy matrix composite, or structural plywood. The end plates can be connected to the top and bottom surfaces of the isolation bearing in a variety of ways. One procedure is—before the vulcanization action which bonds all of the laminae of the bearing together—to place the end plates in contact with the elastomeric material of the end faces of the isolation bearing. Then under heat and pressure the entire unit is bonded together, including the end plates, in the vulcanization process. Another process is to produce an isolation bearing without any attached end plates as described above and then simply to bond end faces of the vulcanized isolation bearing to the structural parts by the use of structural epoxy such as Chemlock® epoxy available from DuPont Corp. of Wilmington, Del.

FIG. 9 depicts a typical installation of an isolation bearing between a structure and its foundation 12 sitting on the natural grade 27 of the ground. During an earthquake, the ground will move horizontally $\ddot{u}_g$ shown by the solid lines, carrying along the foundation which directly sits on it, as depicted in FIG. 10. The dash lines in FIG. 10 represent the seismically undisturbed configuration of the system. The isolation bearing, being highly flexible in the horizontal direction will deform as shown at 28. The bottom of the bearing, i.e. lower end plate 24, that is attached to the foundation moves along with it while the top of the bearing, i.e. upper end plate 21, that is attached to the structure 25, 26 hardly moves at all. This is the basic mechanical action which provides isolation of the structure from earthquake ground motions. To ensure that the bottom of the isolation bearing is firmly attached to the foundation, and that the top of the isolation bearing is firmly attached to the structural base plate, a procedure must be used to connect the end plates of the bearing to the foundation and to the structure. This can be done in several ways. One way is to bolt the end plates to the foundation and to the structural base plate. Another way can be employed if the foundation and the structural base plate happen to be made of wood (as might occur if the structure is a private home). Then an isolation bearing with structural plywood end plates could be used and the end plates could be nailed to the foundation and to the structural base plate. In this particular case if there is sufficient friction between the end plate and the foundation and the end plate and the structural base plate, then a direct connection between them might not be needed; the weight of the structure and friction might be sufficient to ensure that no slipping takes place between these contacting surfaces.

Another way to connect the end plates of an isolation bearing to the foundation and to the structural bearing plate is to use structural epoxy to bond the contacting surfaces together. In some instances isolation bearings without end plates can be used. Such bearings can be directly attached to the foundation and to the structural bearing plate by the use of a structural epoxy to bond the contacting surfaces together.

Design Of A Fiber Reinforced Elastomer Seismic Isolation Bearing

The preliminary design of a fiber-reinforced elastomer seismic isolation bearing is similar to that for a conventional seismic isolation bearing as described in Chapter 5 of the J. M. Kelly book identified earlier. The size of the bearing will, of course, depend on the load, W, to be carried by the bearing. This quantity is known once the structure to be isolated has been designed and a strategy has been selected for the placement of the seismic isolators (e.g., for a framed building, usually one under each column). Below, as a particular example, the design of a fiber reinforced elastomeric seismic isolation bearing of square planform is described. It is based on first using the design procedure for a conventional laminated rubber-steel bearing. Then this design is converted into one for a fiber-reinforced elastomeric seismic isolation bearing. The same methodology would apply to bearings of a circular planform.

Design of a Conventional Seismic Isolation Bearing;

Seismic design specifications will prescribe the quantities:

$f_H$=horizontal frequency of the structure

T=horizontal period of the structure ($T=1/f_H$)

$f_v$=vertical frequency of the structure $\gamma_{max}$=maximum permissible shear strain D=design displacement (from response spectrum or SEAOC formula). SEAOC as used herein refers to the Structural Engineers Association Of California. The procedure also is in accord with the Uniform Building Code—UBC 1994.

The design quantities to be selected are:

a=edge length of planform of square bearing $t_r$=total rubber thickness in the bearing t=thickness of individual rubber layer n=number of rubber layers G=shear modulus of elastomer h=total height of bearing Using the SEAOC formula for the initial design gives $$D=10NZST/B$$

The total thickness of rubber, $t_r$, should not be less than $$t_r=D/\gamma_{max}$$

The parameters N, Z and S are specified and depend on the seismicity and site soil conditions. T, the horizontal period of the structure, has already been prescribed to meet seismic design specifications. The damping factor B depends on the choice of elastomer (rubber in this example) and the level of strain in the bearing. The selection of this factor is based on experience with elastomers used in previous designs, such as those recited above.

The horizontal stiffness of the bearing is $$K_H=GA/t_r$$

and depends on the design load, W, through $$K_H=W(2\pi f_H)^2/g$$

where g is the acceleration due to gravity. Dividing by the area, A, of the square platform of the bearing gives $$G/t_r=p(2\pi f_H)^2/g$$

where p is the average pressure on the bearing. Usually p is taken between 1000 to 1500 psi, with 1000 psi being quite common. Once p is selected, and $\gamma_{max}$ is chosen, the value of $t_r$ can be determined from $t_r=D/\gamma_{max}$. Then the value of G is obtained from the equation given immediately above. If an elastomer with the exact required value of G is not available, p can be slightly adjusted to match an available value of G.

Given W and p, the planform edge length, a, of the square bearing can now be determined ($p=W/a^2$). Next, the number of layers of elastomer must be chosen. The ratio of the planform dimension, a, to the thickness, t, of an individual elastomer layer governs the vertical stiffness of each elastomeric layer. In turn, this layer stiffness controls the overall vertical stiffness of the entire bearing which is made up of alternating layers of elastomer and steel in a conventional base isolator. The ratio of the planform dimension, a, to the thickness, t, of the individual elastomer layer is called the "shape factor," and is indicated by the symbol "S" which is given by $$S=a/4t$$

for a layer with a square planform.

The compression modulus, $E_c$, for a single layer of square planform restrained from lateral expansion at its top and bottom faces is given by $$E_c=6.75\ GS^2$$

(see chapter 5 above which is incorporated herein by reference).

The vertical stiffness for the entire bearing is $$K_v=E_cA/t_r$$

If the vertical frequency, $f_v$, is designated, then $$K_v/K_H=(f_v/f_H)^2$$

In terms of the expressions previously given for these stiffnesses, this can also be written as $$K_v/K_H=E_c/G$$

From the expression for the compression modulus just given above in terms of the shape factor, for a square planform, this results in $$6.75\ S^2=(f_v/f_H)^2$$

or $$S=(f_v/f_H)/2.6$$

Once S is determined, the layer thickness, t, is obtained and the number of layers chosen. Since the number of layers must be an integer it may be necessary to adjust t to ensure $nt=t_r$.

For the conventional steel-rubber seismic isolation bearing, it remains to select the thickness of the steel shims between each layer of rubber, and the end plates at the top and bottom of the bearing. There are no design formulas for these quantities. The shim thickness, $t_s$, is generally taken as not less than 1/10-inch and not greater than 1/8-inch and the end plates are usually between 3/4-inch to 1½-inches thick depending on the overall size of the bearing.

Numerical Example of the Design of a Fiber Reinforced Elastomeric Seismic Isolation Bearing:

As a particular example, consider the design of a seismic isolation bearing of square planform which is to support a load of W=180 Kips. In the SEAOC formula, suppose that the following quantities are specified:

$$N=1.0,\ Z=0.4,\ S=1.2,\ B=1.2$$

Take the conventional choice T=2 sec, so that $f_H$=0.5 Hz. The SEAOC formula then gives for the design displacement, D=8 inches. For an initial choice, take $f_v$=12 Hz, which is a typical vertical frequency for a structure. Then let $\gamma_{max}$, the maximum permissible shear strain, be 200% (a typical value). It then follows that $t_r=D/\gamma_{max}$=4 inches. Thus for this design, a height of 4 inches of rubber free to deform in shear is required. Suppose the pressure p on the bearing is selected as 1250 psi (a typical choice), then the edge length of the square planform of the bearing is determined as: $a^2=(W/p)=180000/1250=144$, so that a=12 inches. Now G is computed from the formula $G=p\ t_r\ (2\pi\ f_H)^2/g$ (which was given in the previous section in a slightly different form). This gives G=127.7 psi. A more readily available value commercially is 125 psi, so that is the value of G that is selected for the design.

It is desired to design the bearing so that the vertical frequency of the structure will be about 12 Hz. This will control the compression modulus required for the constrained rubber layers. In turn, this determines the minimum value of the shape factor which each rubber layer should have. From above, we had: $S=(f_v/f_H)/2.6$. For $f_v$=12 Hz and $f_H$=0.5 Hz, this gives S=9.23. For convenience this is rounded up to S=10. Maintaining $f_H$ at 0.5 Hz, this then gives for $f_v$ for the bearing the value of $f_v=2.6\ (f_H S)$=13 Hz, which is acceptable. The value of $E_c$ this results in is: $E_c=6.75\ G\ S^2=6.75\ (125)(10)^2=84{,}375$ psi.

It is now possible to determine the required thickness, t, of each rubber layer: t=a/(4 S)=0.3 inches. For convenience this value is set at t=5/16 inches (=0.3125 inches). With this information, the number of layers of rubber, n, required in order to accommodate the maximum shearing deformation anticipated is: $n=t_r/t=4/(5/16)=12.8$. As the number of layers must be an integer, n is rounded up so that the value taken for n is: n=13.

For a conventional multilayered steel-rubber bearing, these layers of rubber must be alternated with layers of steel. This gives 12 layers of steel, each with a height of 1/8-inch. To this must be added the two end plates, each with a thickness of 1½ inches. This would then complete the design of the conventional multilayered steel-rubber seismic isolation bearing.

For a pretensioned fiber reinforced elastomeric seismic isolation bearing, the role of the steel that was employed in the conventional multilayered steel-rubber bearing must be replaced by the high stiffness fibers that are distributed throughout the elastomeric matrix of the bearing. These fibers must be apportioned so as to provide sufficient lateral constraint of the "shear" rubber, $t_{sH}$, (i.e., all of the rubber outside of the sheet of reinforcing fiber in the basic lamina) in the same way that the steel shims do. The value of $t_{sH}$ is given by: $t_{sH}=h_l-\phi_l$ (see FIG. 5). This will be accomplished if the effective constraining force of the sheet of fibers, $F_F$, is very large compared to the force, $F_r$ that can be developed in the constrained "shear" rubber when the basic lamina is given a unit extensional strain in the direction of the reinforcing fibers. These forces are given by:

$$F_F=E_F\ A_F,\ \text{and}\ F_r=E_c\ A_r$$

where $E_F$ is Young's modulus for the material out of which the reinforcing fibers are fabricated, $A_F$ is the total cross sectional area of the reinforcing fibers in a basic lamina, $E_c$ is the constrained extensional-compressional modulus of the rubber that is free to shear, and $A_r$ is the total cross sectional area of the rubber that is free to shear in a basic lamina. From FIG. 5 it is seen that $A_F=\pi(\phi_l/2)^2 a/s_l$ and $A_r=a(h_l-\phi_l)$. Thus $$F_F/F_r=(\pi/4)(E_F/E_c)([\phi_l]^2/[h_l-\phi_l]s_l)$$

When this ratio is large compared to unity (i.e., 10 or more), then the stiff pretensioned reinforcing fibers supply sufficient constraint to the "shear" rubber so as to produce a compressive modulus, Ec , which can be predicted from the standard formula $Ec=6.75\ G\ S^2$. Note that this formula for Ec is approximate and is limited to shape factors of less than 10. Ec can never exceed the bulk modulus, k, of the rubber, which for filled natural rubber is about 300,000 psi.

The fibers must also be distributed throughout the matrix so as to produce a shape factor, S, for the free rubber in a basic lamina equal to or larger than that for rubber layers in the equivalent conventional bearing (where, for the square pad, S=a/4t). The shape factor for the pretensioned fiber reinforced bearing (of square planform) is given by $S=a/4t_{sH}$. Thus, for a typical fiber reinforced composite of the type being discussed here, this requirement will always be satisfied. Shape factors will usually be greater than 10 so that the standard formula given above may not be strictly applicable. In that case, to be on the safe side, the bulk modulus, k, of the elastomer will be used to replace $E_c$ in the formula given above for calculating the ratio $F_f/F_r$.

In the example being considered let $h_l=S_l=2\phi_l$, and choose $h_l$ so that S>10. Since $t_{sH}=h_l-\phi_l$, then, in this example, that requires that $t_{sH}=\phi_l$ be less than 0.3 inches. Let $\phi_l$, the diameter of the reinforcing fibers, be 1/8 inch. This gives S=24, so that $E_c$ will be replaced by k in the formula for the ratio $F_F/F_r$. Then this ratio becomes $$F_F/F_r=(\pi/4)(E_F/k)(1/2)$$

If the fibers are taken to be graphite fibers, then $E_F=40\times10^6$ psi, so that $$F_F/F_r=(\pi/4)(40\times10^6/3\times10^5)(1/2)=157$$

This ratio is large compared to unity which establishes that the constraining effect of the reinforcing fibers is adequate.

The height of the bearing is determined by the total required thickness of rubber that is free to shear. As previously determined, this value is 4 inches. In each basic lamina of the pretensioned fiber-reinforced bearing, the thickness of the rubber available for shearing is 1/8 inch. Thus 4/(1/8), or 32, basic laminae are needed to permit the fiber reinforced bearing to have a displacement of 8 inches at the maximum shear strain of 200%. These would be stacked as shown in FIG. 6. Since each basic lamina is 1/4 inch thick, the height of the fiber-reinforced bearing would be (32)×(1/4)=8 inches, which is almost the same height as the conventional steel-rubber bearing. But the fiber reinforced bearing will be lighter due to the lower density of graphite or Kevlar® material as compared to steel. Of course, the height of the bearing can be modified by choosing a different fiber material, a different fiber diameter, a different fiber spacing, and a different basic lamina thickness.

Figure 11:
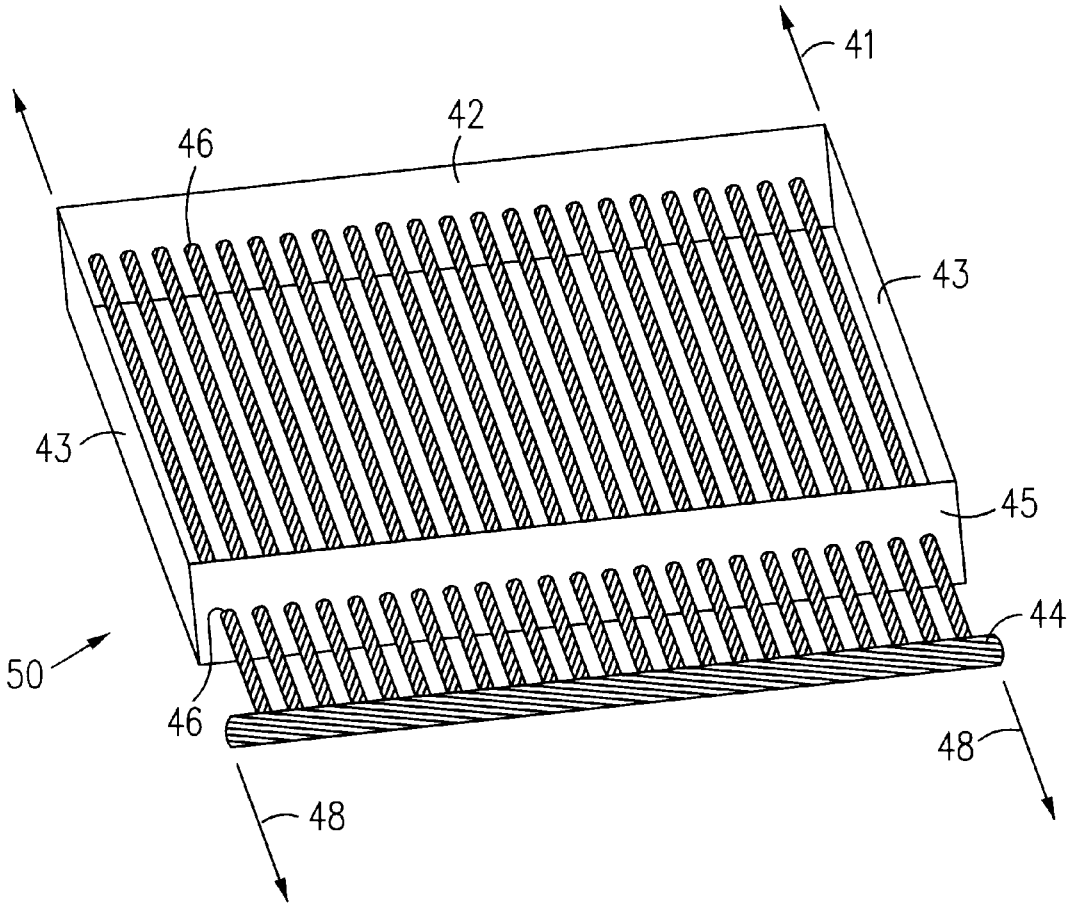
FIG. 11 is a perspective view of a schematic apparatus for pretensioning the reinforcement fibers when they are being molded into a polymerized lamina.
Figure 12:
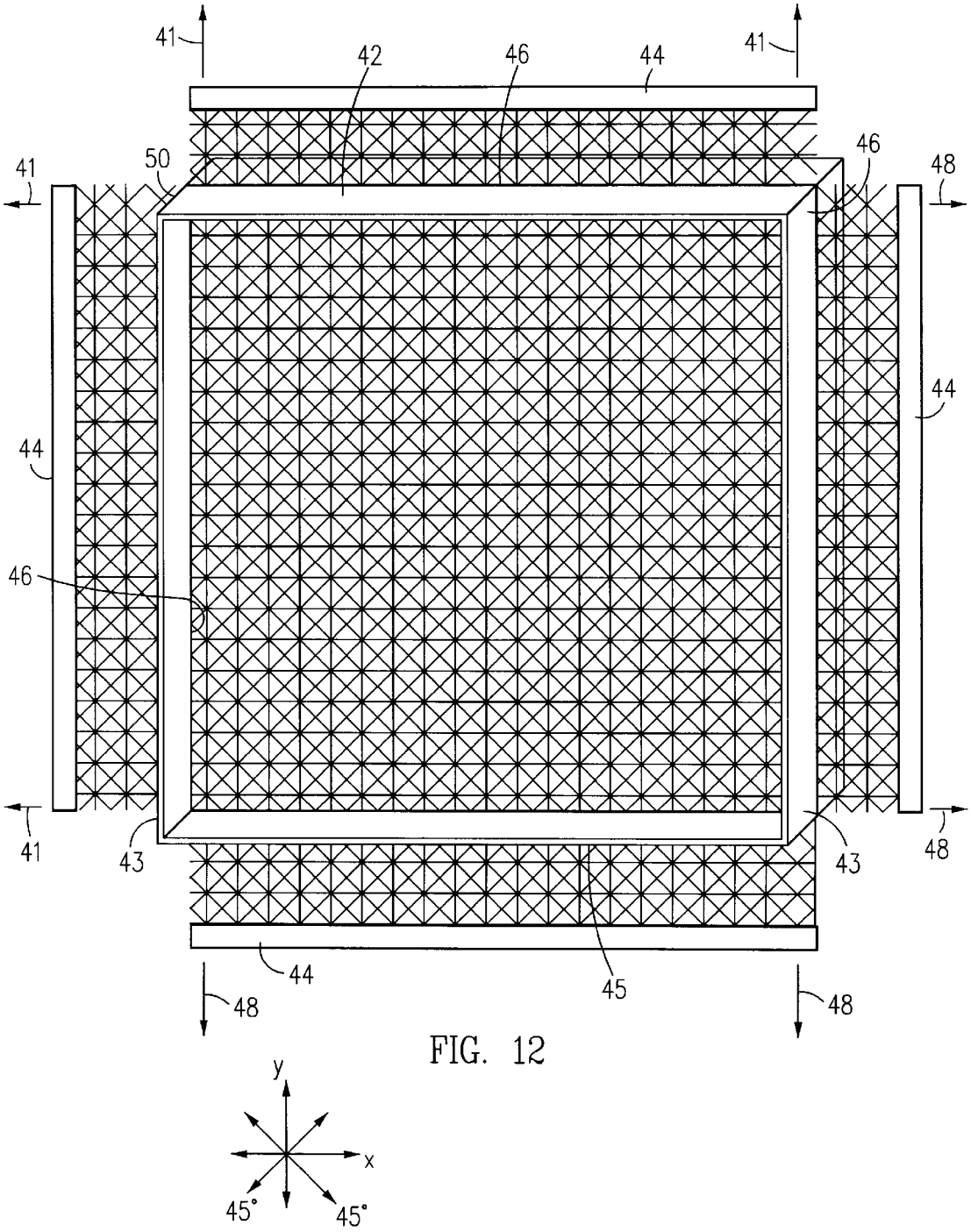
FIG. 12 is a top view of a mold for pretensioning a sheet of fabric having threads extending along an x-axis, a y-axis and an axis at 45° from the x and y axes.

FIG. 11 schematically shows an apparatus for pretensioning the Kevlar® fibers or graphite fibers. The apparatus comprises a molding frame 50 having side edges 43, a base side edge 42 which firmly mounts each fiber (or an edge of a fibrous sheet forming the fibers within each lamina), for example by having knotted ends or by sinuously threading the fibers through apertures 46 in the frame side walls and end walls (as in stringing a tennis racket). The base side edge 42 is fixedly attached shown by arrows 41 to a reaction or pull-bar 44 or a fixed structure for holding the frame from horizontal movement. The fibers (or fibrous sheet) extend through apertures or a slot 46 in wall 45 connecting side walls 43 and are attached to a pull rod 44 which is pulled by a force indicated by arrows 48 to remove fiber slack such as by use of a pulley/weight or a hydraulic or other actuator. Preferably the fibers or sheets are pretensioned by a force of from about one pound to about 10 pounds per fiber. The sheets are to be pretensioned in both X and Y axes and in an axis at 45° angle to the x and y axes in the same manner as shown in FIG. 11 or otherwise such as by having reaction bars 44 at all four edges of the frame. This is shown in FIG. 12. Care should be taken not to over pre-tension the fibers since it is desirous that the pretensioned fibers, when the lamina is removed from the frame 50, do not buckle or wrinkle the semi-vulcanized lamina. The individual fibers or fibers in a sheet typically will be from about 0.1 mm to about 1.0 mm in thickness.

After pretensioning, the frame serves as a mold for pouring in liquefied or semi-liquefied rubber which is cured, typically at a temperature of from about 200° C. to about 300° C. for about 30 to about 120 minutes. After each lamina is cut out and properly oriented as to the direction of the pretensioned fibers or sheet of fibers, the stack of laminae and the end plates are placed in a vulcanized adherent connection with each other by clamping the stack together, typically at a pressure of about 1500 to 3000 psi and at a temperature of from about 200° C. to about 300° C.(dependent on the chosen rubber) for about from 30 minutes to about 120 minutes to effect vulcanization. The completed isolation bearing will typically have a bulk modulus ranging from 1000 to 1500 psi.

Alternatively, the pretensioned fibers may extend over a frame which is of a height to accommodate all or essentially all of the height of the bearing, with the pretensioned fibers extending at prescribed directions at different levels of the frame. The unpolymerized material or unvulcanized rubber may be poured or extruded in situ into the resultant mold and then cured or vulcanized to form the seismic isolation bearing.

Many structures have fundamental frequencies of vibration within the band of frequencies where the energy of earthquake ground motions are a maximum. In such cases a structure will amplify the seismic ground vibrations and produce accelerations within the structure which increase from the bottom of the structure to its top. Besides producing undesirable levels of acceleration in the structure, these amplified structural motions can cause severe stresses in structural elements and large relative motions between different parts of the structure. This can result in permanent damage to parts of the structure, or even to catastrophic collapse. The amplified accelerations throughout the structure act on the occupants and contents of the structure and can cause harm and damage to occupants and contents even when no structural damage occurs. The new cost-effective procedure of this invention mitigates such effects to isolate the structure from earthquake ground motions by the use of pretensioned fiber-reinforced elastomeric seismic base isolation bearings.

The use of seismic isolation bearings permits the structure that they support to be less strong than would be required if the structure were to be firmly attached (through a conventional foundation) directly to the ground. This results in a lower cost and lower weight structure. For this reason, the employment of seismic isolation bearings of the invention is not only an efficient seismic design strategy for new structures, but is an exceptionally effective method for the practical and economical retrofitting of structures that do not meet current seismic standards, or for which a higher degree of safety is desired.

A recent study of the economics of seismic isolation points out the many advantages of seismic base isolation. The reduction in design force levels and in bracing and curtain wall requirements achievable with seismic isolation often leads to a saving in the cost of the structure that not only offsets the additional cost of base isolators and their installation, but also results in a lowering of the final overall construction cost. Furthermore, an earthquake mitigation method such as seismic isolation, can significantly reduce earthquake insurance premiums, resulting in a very considerable savings over the lifetime of the structure. As previously mentioned, the greatly reduced motion of the structure provided by seismic isolation of this invention can prevent damage to the structure and its contents, and thereby in the event of an earthquake-result in reduction of injuries to people, the saving of lives, and immense economic savings. Seismic isolation of the type described herein permits a structure to function substantially normally in the aftermath of potentially damaging earthquakes. This would be especially important for such structures as hospitals, communications centers, emergency centers, power stations, disaster response centers, etc. Proper isolation of such structures as nuclear power plants, chemical plants, oil refineries and processing plants can also prevent potentially catastrophic area-wide secondary harm from occurring due to damage of such systems as a consequence of an earthquake.

For many businesses and industries, the most significant benefit deriving from seismic isolation can be the prevention of loss of operation in the aftermath of an earthquake. Interruption of business function, or the production of product, can mean a major loss of current and future market share for a variety of commercial enterprises. This is especially true for those industries heavily involved in "on-time" manufacturing and delivery (e.g., electronic component manufacturing, computer manufacturing, automobile supplies manufacturing, etc.). If such businesses cease operation even for a short period of time, they can suffer a permanent loss of their customer base and will not be able to survive.

Thus it is seen that there are great benefits that follow from the use of this invention of seismic base isolation to protect structures from the ravages of earthquakes. Of the different devices that can be used to produce seismic isolation, a most beneficial one is the fiber-reinforced elastomeric seismic base isolator. There are several advantages of a fiber-reinforced elastomeric seismic base isolator in comparison to a conventional elastomeric seismic isolator. In a conventional elastomeric and steel seismic base isolator, the lateral constraint of the elastomer is provided by the use of steel plates rather than fiber reinforcement. This results in a device which is much heavier than the pretensioned fiber reinforced elastomeric isolation bearing and much more expensive to transport to, and much more difficult to manipulate on, the construction site. The manufacture of the conventional device is also more time-consuming, difficult and expensive than the bearing of the present invention. Manufacture of pretensioned fiber-reinforced elastomeric seismic isolation bearings may be accomplished on demand in a much more timely fashion—and in a greater variety of configurations and capabilities—than is now true for conventional isolators. Furthermore, the isolators of this invention will have greater reliability. Thus the use of pretensioned fiber-reinforced elastomeric seismic isolation bearings will result in very considerable cost savings and convenience.

We claim:

1. An elastomeric seismic isolation bearing comprising:

a stacked series of elastomeric laminae forming a unit cell having a stacked height corresponding to an overall horizontal and vertical stiffness of the unit, the laminae being in a vulcanized adherent connection with each other; and wherein at least one of the laminae includes a series of pretensioned continuous fibers extending across opposite side edges of the at least one laminae.

2. The isolation bearing of claim 1 further comprising at least a pair of said laminae including a series of parallel pretensioned continuous fibers extending across opposite side edges of said pair of laminae, one of said pair of laminae having fibers extending at an angle from fibers of the other of said pair.

3. The isolation bearing of claim 2 wherein said angle is an angle of from about 45° to about 90°.

4. The isolation bearing of claim 2 wherein said angle is at a 45° bias from a side edge of said pair of laminae.

5. The isolation bearing of claim 2 wherein the unit cell is a rectangular block and wherein fibers in said one lamina extend orthogonally to fibers in the other lamina.

6. The isolation bearing of claim 5 further including at least one additional lamina having pretensioned fibers extending on an about 45° bias from the orthogonal fibers.

7. The isolation bearing of claim 6 further comprising a series of stacked unit cells in vulcanized adherent connection.

8. The isolation bearing of claim 6 wherein said fibers in each of said laminae are in the form of a woven sheet.

9. The isolation bearing of claim 6 wherein said fibers are each attached to a pulling frame to provide a tensile force on said fibers prior to the vulcanized adherent connection of said laminae.

10. The isolation bearing of claim 1 further including at least one additional elastomeric laminae without fibers and stacked on said cell in a vulcanized adherent connection with said series of elastomeric laminae.

11. The isolation bearing of claim 1 further including a series of stacked unit cells in vulcanized adherent connection.

12. The isolation bearing of claim 11 wherein fibers in one cell are orthogonally oriented from fibers in another cell.

13. The isolation bearing of claim 12 further including additional elastomeric laminae without fibers interleaved within each cell and in vulcanized adherent connection between fiber-containing laminae.

14. The isolation bearing of claim 1 further including a first end plate connectable to a structure foundation, said first end plate being in an adherent connection to an end laminae of said cell and a second end plate connected to a structure, said second end plate being in an adherent connection to an opposite end laminae of said cell.

15. The isolation bearing of claim 14 wherein said structure is a building column or load bearing wall or shear wall.

16. The isolation bearing of claim 14 wherein said end plates are in a vulcanized adherent connection to the respective end laminae of the cell.

17. The isolation bearing of claim 14 wherein the end plates are in an epoxy adherent connection to the respective end laminae of the cell.

18. The isolation bearing of claim 1 wherein said fibers are a polyamide polymer.

19. The isolation bearing of claim 18 wherein said fibers have a diameter of from about 0.1 mm to about 1 mm.

20. The isolation bearing of claim 1 wherein said fibers are graphite fibers having a diameter of from about 0.1 mm to about 1 mm.

21. The method of seismically protecting a structure to be connected to a structure foundation comprising:

providing a series of planforms of an elastomeric material having parallel pretensioned fibers extending within the planforms;

orienting at least two of the planforms such that the parallel pretensioned fibers of a first one of the planforms extends at an angle to the parallel pretensioned fibers of a second one of the planforms;

stacking the planforms into a unit cell;

stacking a series of said unit cells to form a seismic isolation bearing;

vulcanizing the series of unit cells to each other; and adhering one surface of the vulcanized series of cells to the structure and an opposite surface of the vulcanized series of cells to an opposite surface of the vulcanized series of cells.

22. The method of claim 21 further including providing first and second end plates to the stack of unit cells; and wherein said step of adhering comprises adhering the first and second end plates to the structure and the structure foundation, respectively.

* * * * *